US008424711B2

(12) United States Patent
Charbonnet et al.

(10) Patent No.: US 8,424,711 B2
(45) Date of Patent: Apr. 23, 2013

(54) DISPOSABLE BEVERAGE LID

(75) Inventors: Jonathan Charbonnet, Upland, CA (US); Tricia Charbonnet, Upland, CA (US); Nicholas Charbonnet, Upland, CA (US)

(73) Assignee: Green Bean Packaging, LLC

( * ) Notice: Subject to any disclaimer, the term of this patent is extended or adjusted under 35 U.S.C. 154(b) by 316 days.

(21) Appl. No.: 12/771,905

(22) Filed: Apr. 30, 2010

(65) Prior Publication Data

US 2011/0266294 A1 Nov. 3, 2011

(51) Int. Cl.
*A47G 19/22* (2006.01)
*B67D 3/00* (2006.01)

(52) U.S. Cl.
USPC ..... 220/713; 220/703; 220/711; 220/717; 220/719; 222/482

(58) Field of Classification Search ..... 220/703, 220/711, 713, 717, 719; 222/482, 529
See application file for complete search history.

(56) References Cited

U.S. PATENT DOCUMENTS

| | | | | |
|---|---|---|---|---|
| 3,730,399 | A * | 5/1973 | Dibrell et al. | 222/482 |
| 6,102,244 | A * | 8/2000 | Kuwano et al. | 220/713 |
| D516,424 | S | 3/2006 | Schweigert et al. | |
| 7,100,790 | B2 * | 9/2006 | Dark | 220/711 |

* cited by examiner

*Primary Examiner* — Anthony Stashick
*Assistant Examiner* — Madison L Poos
(74) *Attorney, Agent, or Firm* — Stetina Brunda Garred & Brucker

(57) ABSTRACT

Embodiments of the invention are directed to disposable beverage lids which may be used in conjunction with beverage containers. In one embodiment, a disposable beverage lid is generally circular and configured to removeably couple to a beverage container. The lid may include an elevated rim in-set and about the periphery thereof with a dome within a recess defined by the elevated rim. A plurality of apertures may be located within a channel defined by an inner wall of the elevated rim and an outer periphery of the dome.

32 Claims, 2 Drawing Sheets

DISPOSABLE BEVERAGE LID

FIELD OF INVENTION

At least one feature pertains to a disposable beverage lid.

BACKGROUND OF INVENTION

Disposable hot beverage containers and suitable lids for these containers are critical supply items for any business serving hot beverages. In order to meet the needs of both the company and the customer, a disposable lid must at least meet the following criteria: the lid must be inexpensive to manufacture, import and/or purchase; the lid must adequately couple to the container; and the lid must be user-friendly to the consumer.

Since disposable lids are generally manufactured for single use, the cost to manufacture is extremely important, especially to those businesses whose principle product is hot beverages (e.g., a coffee shop). At the same time, however, the lid must adequately couple to the container to reduce the chance of the hot beverage spilling and potentially injuring the consumer or causing damage (i.e., stains) to garments worn by the consumer. Additionally, the lid must be user-friendly in manipulation so that the consumer can remove the lid, e.g., add sugar, sugar substitutes, milk, cream, etc., without causing the beverage to spill and user-friendly in use to allow the consumer to drink from the cup (i.e., a drinking port) without removing the lid from the cup.

SUMMARY OF INVENTION

A device for coupling to a disposable cup, comprising: a beverage lid having: (i) a beverage container coupling portion; (ii) a flange extending downwardly from the coupling portion; and (iii) an elevated rim extending upwardly from an inner periphery of the coupling portion wherein the elevated rim defines a recess therein, a bottom of the recess substantially defined by a dome wherein an inner periphery of the elevated rim and an outer periphery of the dome define a channel, a plurality of apertures within the channel is herein disclosed.

The elevated rim may be double-walled. The plurality of apertures may provide a metered flow of liquid when the beverage lid is coupled to a disposable cup and tilted relative to a horizontal plane. In one embodiment, the plurality of apertures is symmetrically spaced about the entire channel. In another embodiment, the plurality of apertures is aggregated in at least one group within the channel. In either embodiment, the plurality of apertures is adjacent to the inner periphery of the elevated rim. The beverage container coupling portion may be configured to removeably couple to a rim of a beverage cup. A material comprising the beverage lid may comprise polystyrene or a derivative thereof. In one embodiment, each aperture is 0.050 inches in width.

A disposable lid, the lid comprising: a unitary, circular structure adapted to removeably couple to a rim of a disposable cup, the structure including an elevated rim with a plurality of drinking ports adjacent an inner periphery of the elevated rim and a dome within an area defined by the inner periphery of the elevated rim is herein disclosed. An outer periphery of the dome and the inner periphery of the elevated rim may define a channel. The elevated rim may be double-walled. The plurality of drinking ports may provide a metered flow of liquid when the lid is coupled to the disposable cup and tilted relative to a horizontal plane.

In one embodiment, the plurality of drinking ports is symmetrically spaced about the entire channel. In another embodiment, the plurality of drinking ports is aggregated in at least one group within the channel. The disposable lid may further comprise a disposable cup coupling portion about the elevated rim on an outer periphery thereof. The disposable lid may further comprise a flange extending downwardly from the coupling portion. A material comprising the beverage lid may comprise polystyrene or a derivative thereof. In one embodiment, each aperture is 0.050 inches in width.

DETAILED DESCRIPTION

The following detailed description is of the best currently contemplated modes of carrying out the invention. The description is not to be taken in a limiting sense, but is made merely for the purpose of illustrating the general principles of the invention.

Embodiments of the invention are directed to disposable beverage lids which may be used in conjunction with beverage containers. In one embodiment, a disposable beverage lid is generally circular and configured to removeably couple to a beverage container. The lid may include an elevated rim in-set and about the periphery thereof with a dome within a recess defined by the elevated rim. A plurality of apertures may be located within a channel defined by an inner wall of the elevated rim and an outer periphery of the dome.

Figure 1:
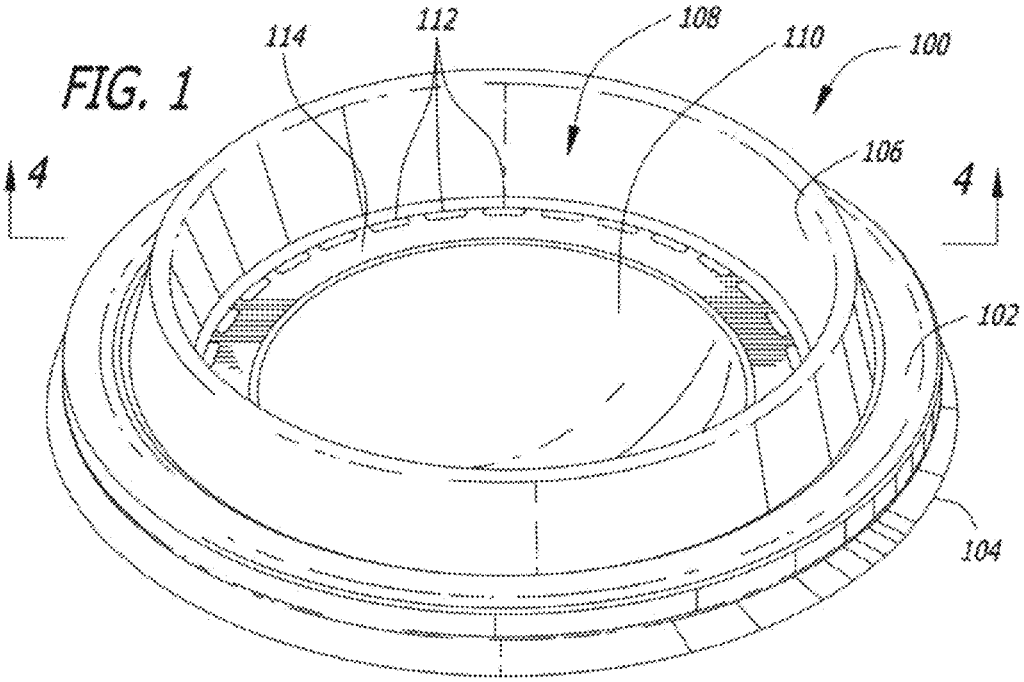
FIG. 1 is a perspective view of a disposable beverage lid according to an embodiment of the invention.

FIG. 1 is a perspective view of a disposable beverage lid according to an embodiment of the invention. As shown, a disposable beverage lid 100 may be generally circular in shape and configured to removeably couple to a beverage container (not shown). In one embodiment, the lid 100 includes a beverage container coupling portion 102 with a flange 104 extending downwardly therefrom and an elevated rim 106 extending upwardly from an inner periphery of the coupling portion 102. The coupling portion is configured to removeably couple to the bead (or rim) about a periphery of a cup as known by one of ordinary skill in the art. The elevated rim 106 defines a recess 108 in which a dome 110 is located therein. A plurality of apertures 112, or "drinking ports", may be situated within a channel 114 defined by an outer periphery of the dome 110 and an inner periphery of the elevated rim 106. Materials which comprise the lid 100 include, but are not limited to, polystyrene and polystyrene combined with copolymers such as polybutadiene, acrylonitrile butadiene styrene, or divinylbenzene. A thickness of the material may be between about 0.005 inches and about 0.020 inches, in one embodiment, about 0.010 inches.

Figure 2:
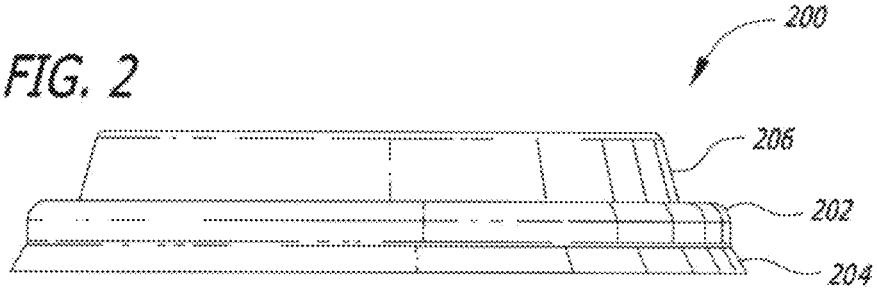
FIG. 2 is a rear view of the disposable beverage lid of FIG. 1.

FIG. 2 is a rear view of a disposable beverage lid 200, corresponding to the disposable beverage lid 100 of FIG. 1. FIG. 2 shows beverage container coupling portion 202, flange 204 and elevated rim 206. As shown, flange 202 extends downwardly and is angled in an outwardly direction relative to the coupling portion 202. On the other hand, elevated rim 206 extends upwardly and is angled in an inwardly direction relative to the coupling portion 202. In one embodiment, elevated rim 206 is in-set relative to coupling portion 202. That is, elevated rim 206 extends upwardly beginning from the inner periphery of the coupling portion 202.

Figure 3:
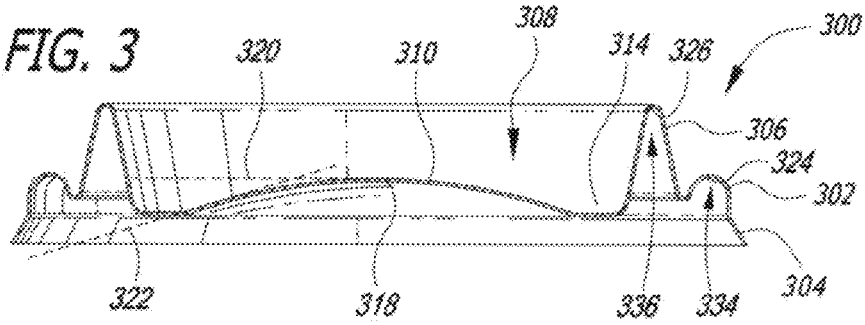
FIG. 3 is a front cross-sectional view of the disposable beverage lid of FIG. 1 taken along lines 4-4.

FIG. 3 is a front cross-sectional view of a disposable lid 300, corresponding to the disposable beverage lid 100 of FIG. 1 taken along lines 4-4. FIG. 3 shows beverage container coupling portion 302, flange 304, elevated rim 306, recess 308, dome 310 and channel 314. According to this embodiment, elevated rim 306 is doubled-walled with an outer wall angling upwardly and inwardly and an inner wall angling downwardly and inwardly as well. As shown, dome 310 defines a bottom of the recess 308 and is substantially recessed therein. That is, the highest point of the dome 310 is substantially lower relative to the uppermost portion of the elevated rim 306. In further detail, the dome 310 defines a center 318, and at such center 318. a curvature of the dome 310 defines a center tangent line 320. As shown, the channel 314 is parallel to the center tangent line 320. Furthermore, also as shown, a tangent 322 of the curvature of the dome 310 where it joins with the channel 314, i.e., at its outer coupling, is in an angular relationship that is offset to the channel 314. The beverage coupling portion defines a first reverse bottom-facing surface 324 that is configured to mate with a lip of the beverage container. The elevated rim 306 defines a second reverse bottom-facing surface 326 that is open to the beverage container when mated thereto. The first reverse bottom-facing surface 324 and the second reverse bottom-facing surface 324 may also partly define respective grooves 334, 336.

Figure 4:
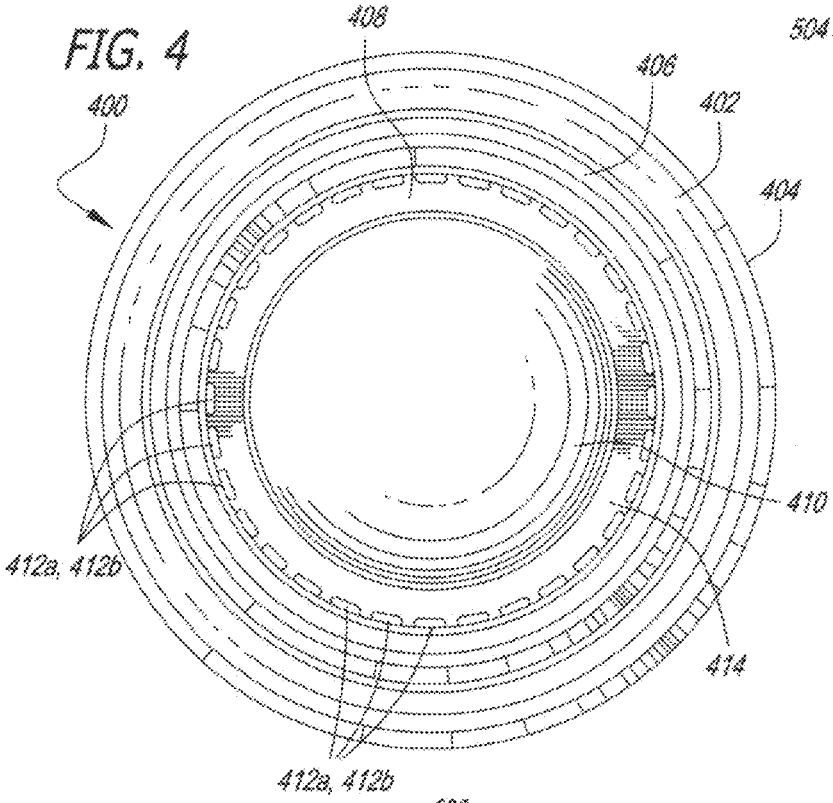
FIG. 4 is a top aerial view of the disposable beverage lid of FIG. 1.

FIG. 4 is a top aerial view of a disposable beverage lid 400, corresponding to the disposable beverage lid 100 of FIG. 1. FIG. 4 shows beverage container coupling portion 402 flange 404, elevated rim 406, recess 408, dome 410 channel 414 and the plurality of apertures 412. In one embodiment, the plurality of apertures 412 may be symmetrically spaced within the channel 414 and adjacent the inner periphery of the elevated rim 406. In other embodiments, the plurality of apertures may be bunched together, or aggregated in a group, in one or more locations within the channel (not shown). Utilizing the view shown in FIG. 4, for example, there may be a first group of aggregated apertures 412*a*, and a different second group of aggregated apertures 412*b*. The plurality of apertures 412 may number from two (2) to forty-five (45), in one embodiment, thirty-two (32). According to embodiments of the invention. The plurality of apertures 412 may be approximately circular, oblong or any other suitable geometric shape; however, in any embodiment, the plurality of apertures 412 should collectively or singly allow a volume of liquid to pass through when coupled to a beverage cup (not shown) and when a consumer is drinking from the cup. That is, the plurality of apertures 412 provide a metered flow of liquid when the lid 400 is coupled to a disposable cup and tilted relative to a horizontal plane. Each aperture may be between about 0.025 inches and about 0.100 inches in width, in one embodiment, about 0.050 inches in width.

Figure 5:
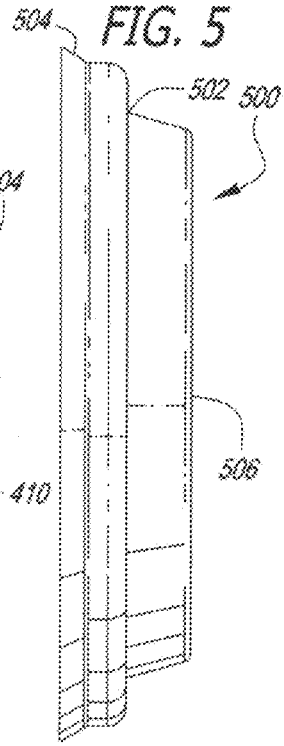
FIG. 5 is a side view of the disposable beverage lid of FIG. 1.

FIG. 5 is a side view of a disposable beverage lid 500, corresponding to the disposable beverage lid 100 of FIG. 1. FIG. 5 shows beverage container coupling portion 502, flange 504 and elevated rim 506.

Figure 6:
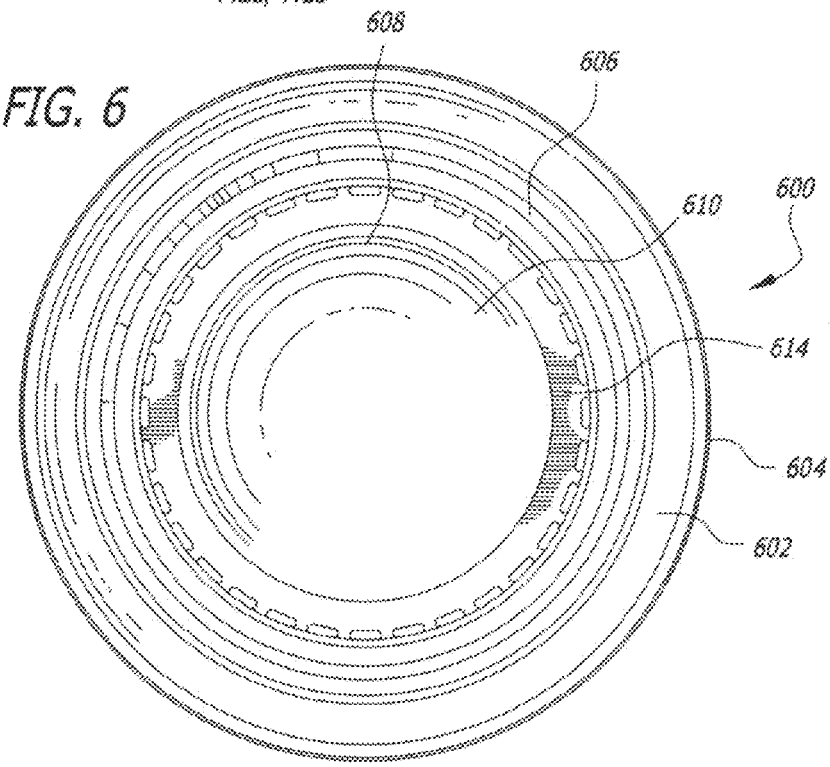
FIG. 6 is a bottom aerial view of the disposable beverage lid FIG. 1

FIG. 6 is a bottom aerial view of a disposable beverage lid 600, corresponding to the disposable beverage lid 100 of FIG. 1. FIG. 6 shows beverage container coupling portion 602, flange 604, elevated rim 606, recess 608, dome 610, channel 614 and the plurality of apertures 612.

One conventional beverage lid includes a drinking port on a peripheral rim of the lid. When the cup coupled to the beverage lid is subjected to motion, i.e., when a consumer is walking or when the cup is in a cup holder in a car, liquid has a tendency to spill out of the drinking port. Moreover, this type of lid often includes additional openings for heat ventilation (in the case when the liquid is hot). These additional openings can also be sources of spillage. A solution is to temporarily cap the drinking port with a so-called "splash stick", however, this solution is not user-friendly as it does not allow the consumer to drink the beverage without removing the "splash stick" and does not completely prevent spillage. Moreover, this solution does not address spillage from the heat ventilation openings.

Another conventional beverage lid includes a "living hinge" which can partially cap the drinking port. Again, this type of lid often includes additional openings for heat ventilation (in the case when the liquid is hot). This solution is not user-friendly as it does not always function properly and does not completely prevent spillage. For example, a defective hinge may be removed by the consumer thereby defeating the purpose of the hinge (i.e., to prevent spillage). Again, this solution does not address spillage from the heat ventilation openings.

The beverage lid as described previously according to embodiments of the invention has advantages over conventional lids. For example, the lid's specific geometry, i.e., the dome within the recess defined by the elevated rim and the plurality of apertures (drinking ports) within the channel, substantially or completely prevents the fluid from spillage while dynamic, i.e., while moving (sloshed around). More particularly, because the drinking ports are not on the rim but rather distanced from the edge of the lid, i.e., on the interior of the elevated rim, spillage is substantially or completely eliminated. The elevated rim functions as a barrier to prevent or substantially prevent liquid from spilling over. Moreover, the dome within the recess defined by the elevated rim forces the liquid to stay in the channel if there is any residual liquid once the consumer takes a drink.

Additionally, because there are numerous drinking ports, the need for additional openings to vent the lid is eliminated. That is, the sizing and spacing of the drinking ports simultaneously function as drinking ports and heat ventilation openings. Moreover, the sizing and spacing of the drinking ports provide a metered flow of fluid completely controlled by the consumer. Additionally, the lid according to embodiments of the invention allows for the consumer to drink from any edge. Additionally, heat transfer properties attributable to a lower volume of space between the lid and the hot fluid show an unexpected result that the liquid stays hot longer when compared to conventional lids.

While certain exemplary embodiments have been described and shown in the accompanying drawings, it is to be understood that such embodiments are merely illustrative of and not restrictive on the broad invention, and that this invention is not to be limited to the specific constructions and arrangements shown and described, since various other modifications may occur to those ordinarily skilled in the art.

What is claimed is:

1. A device for coupling to a beverage container, comprising:

a beverage id of a unitary construction having:

a beverage container coupling portion defining a first reverse bottom-facing surface configured to at least partially mate with a lip of the beverage container;

a flange extending downwardly from the coupling portion;

an elevated rim extending upwardly from an inner periphery of the coupling portion with the elevated rim defining a recess with a bottom substantially defined by a dome and a flat channel extending between an inner periphery of the elevated rim and an outer periphery of the dome in a angular relationship offset form a curvature of the dome, and further defining a second reverse bottom-facing surface open to the beverage container upon fixation of the beverage lid thereto; and a plurality of apertures within the flat channel.

2. The device of claim 1 wherein the elevated rim is double-walled.

3. The device of claim 1 wherein at least one of the plurality of apertures provides a metered flow of liquid when the beverage lid is coupled to the beverage container and tilted relative to a horizontal plane.

4. The device of claim wherein the plurality or apertures is symmetrically spaced about the entire channel.

5. The device of claim 1 wherein the plurality of apertures is aggregated in at least one group within the channel.

6. The device of claim 4 wherein the plurality of apertures is adjacent to the inner periphery of the elevated rim.

7. The device of claim 5 wherein the plurality of apertures is adjacent to the inner periphery of the elevated rim.

8. The device of claim 1 wherein the beverage container coupling portion is configured to removeably couple to a rim of the beverage container.

9. The device of claim 1 wherein a material comprising the beverage lid comprises polystyrene or a derivative thereof.

10. The device of claim 1 wherein at least one of the plurality of apertures is approximately 0.050 inches in width.

11. The device of claim 1, wherein the first bottom-facing surface at least partially defines a first groove and the second bottom-facing surface at least partially defines a second groove.

12. A lid, the lid comprising:

a unitary, circular structure adapted to removeably couple to a rim of a cup, the structure including an elevated rim, a dome within an area defined by an inner periphery of the elevated rim, and a channel defined between an outer periphery of the dome and the inner periphery of the elevated rim, the channel being in an angular relationship offset from a tangent of a curvature of the dome at the outer periphery thereof, and a reverse of the elevated rim defining a surface open to the cup with the circular structure being coupled to the rim of the cup.

13. The lid of claim 12 wherein the elevated rim is double-walled.

14. The lid of claim 12 wherein a plurality of drinking ports provide a metered flow of liquid when the lid is coupled to the disposable cup and tilted relative to a horizontal plane.

15. The lid of claim 14 wherein the plurality of drinking ports is symmetrically spaced about the entire channel.

16. The lid of claim 14 wherein the plurality of drinking ports is aggregated in at least one group within the channel.

17. The lid of claim 12, further comprising, a cup coupling portion about the elevated rim on an outer periphery thereof.

18. The lid of claim 17, further comprising, a flange extending downwardly from the cup coupling portion.

19. The lid of claim 12 wherein a material comprising the structure comprises polystyrene or a derivative thereof.

20. The lid of claim 14 wherein at least one of the plurality of drinking ports is approximately 0.050 inches in width.

21. The device of claim 12, wherein the channel is parallel to a tangent of a curvature of the dome at a center thereof.

22. The device of claim 12, wherein the surface is part of a groove defined by the reverse of the elevated rim.

23. A lid with an integral, unitary lid structure having an exterior side and an opposed interior side interfacing with an opening of a beverage container, the lid comprising:

a circular outer splash reception channel defined by the interior side of the lid structure;

a central splash deflection surface defined by the interior side of the lid structure and surrounded by the circular outer splash reception channel; and a plurality of spaced splash redirection cover elements interconnecting the outer splash reception channel and the central splash deflection surface, the splash redirection cover elements being an angular relationship offset from the central splash deflection surface.

24. The lid of claim 23, wherein adjacent to the plurality of spaced redirection cover elements there is corresponding defined a plurality of apertures.

25. The lid of claim 24, wherein at least one of the plurality of apertures provide a metered flow of liquid when the lid is coupled to the beverage container and tilted relative to a horizontal plane.

26. The lid of claim 24, wherein the plurality of apertures corresponds to a splash escapement segment, with liquid splashed otherwise blocked from escapement by the splash reception channel, the splash deflection surface, and the splash redirection cover elements.

27. The lid of claim 23, wherein a first part of the central splash deflection surface has a semi-spherical shape.

28. The lid of claim 27, wherein a second part of the central splash deflection surface as a flat, annular shape contiguous with each of the splash redirection cover elements.

29. A device for coupling to a beverage container, comprising:

a beverage lid of a unitary construction having:

a beverage container coupling portion defining a first reverse bottom-facing surface configured to at least partially mate with a lip of the beverage container;

a flange extending downwardly from the coupling portion;

an elevated rim extending upwardly from an inner periphery of the coupling portion with the elevated rim defining a recess with a bottom including a dome and a flat channel extending between an inner periphery of the elevated rim and an outer periphery of the dome, and further defining a second reverse bottom-facing surface open to the beverage container upon fixation of the beverage lid thereto;

wherein the flat channel defines a plurality of apertures, spacing between each of the apertures being less than the size of the apertures.

30. The device of claim 29 wherein the plurality of apertures is symmetrically spaced about the entirety of the channel.

31. The device of claim 29 wherein the plurality of apertures is adjacent to the inner periphery of the elevated rim.

32. The device of claim 29, wherein the first bottom-facing surface at least partially defines a first groove and the second bottom-facing surface at least partially defines a second groove.

* * * * *